US008147208B2

(12) United States Patent
Hagshenas et al.

(10) Patent No.: US 8,147,208 B2
(45) Date of Patent: Apr. 3, 2012

(54) AXIALLY SEGMENTED IMPELLER

(75) Inventors: Behzad Hagshenas, San Diego, CA (US); Anthony C. Jones, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 565 days.

(21) Appl. No.: 12/392,160

(22) Filed: Feb. 25, 2009

(65) Prior Publication Data

US 2010/0215508 A1 Aug. 26, 2010

(51) Int. Cl.
*B63H 1/26* (2006.01)
*B63H 7/02* (2006.01)

(52) U.S. Cl. ..... 416/234; 416/213 R; 415/134; 415/135

(58) Field of Classification Search ..... 415/134, 415/135; 416/234, 185, 182, 21 R, 213 R, 416/213 A, 223 R, 147; 29/889, 889.23
See application file for complete search history.

(56) References Cited

U.S. PATENT DOCUMENTS 3,412,978 A * 11/1968 Keenan et al. ..... 415/228
3,612,719 A * 10/1971 Nomura ..... 416/133
7,048,506 B2 * 5/2006 Atmur et al. ..... 416/30

* cited by examiner

*Primary Examiner* — David Nhu
(74) *Attorney, Agent, or Firm* — Stephen G. Mican

(57) ABSTRACT

An impeller with an axial inlet in relation to an impeller axis for pressurizing a fluid has: a nose section that has a nose section central hub and multiple nose vane sections, each nose vane section extending from a leading edge to a generally radial nose section interface plane; a tail section that has a tail section central hub and multiple tail vane sections, each tail vane section extending from a generally radial tail section interface plane to a vane tip; a coupling that joins the nose section central hub to the tail section central hub and aligns each one of the nose vane sections with a corresponding one of the tail vane sections with an axial gap between the radial nose section interface plane and the radial tail section interface plane.

24 Claims, 2 Drawing Sheets

AXIALLY SEGMENTED IMPELLER

FIELD OF THE INVENTION

The invention relates to turbomachinery, and more particularly to compressor impellers for turbomachinery.

BACKGROUND OF THE INVENTION

The impeller used in various turbomachinery typically comprises titanium or aluminium for strength-to-weight reasons. Use of these materials may create a durability problem due to ingested foreign object damage if the impeller has to operate in an environment that may include ice particles, snowy conditions, fluids or any other foreign object, be it hard or soft, that may pass through any inlet screen for the impeller.

SUMMARY OF THE INVENTION

The invention generally comprises an impeller with an axial inlet in relation to an impeller axis for pressurising a fluid that comprises: a nose section that has a nose section central hub and multiple nose vane sections, each nose vane section extending from a leading edge to a generally radial nose section interface plane; a tail section that has a tail section central hub and multiple tail vane sections, each tail vane section extending from a generally radial tail section interface plane to a vane tip; a coupling that joins the nose section central hub to the tail section central hub and aligns each one of the nose vane sections with a corresponding one of the tail vane sections with an axial gap between the radial nose section interface plane and the radial tail section interface plane.

DETAILED DESCRIPTION OF THE INVENTION

Figure 1:
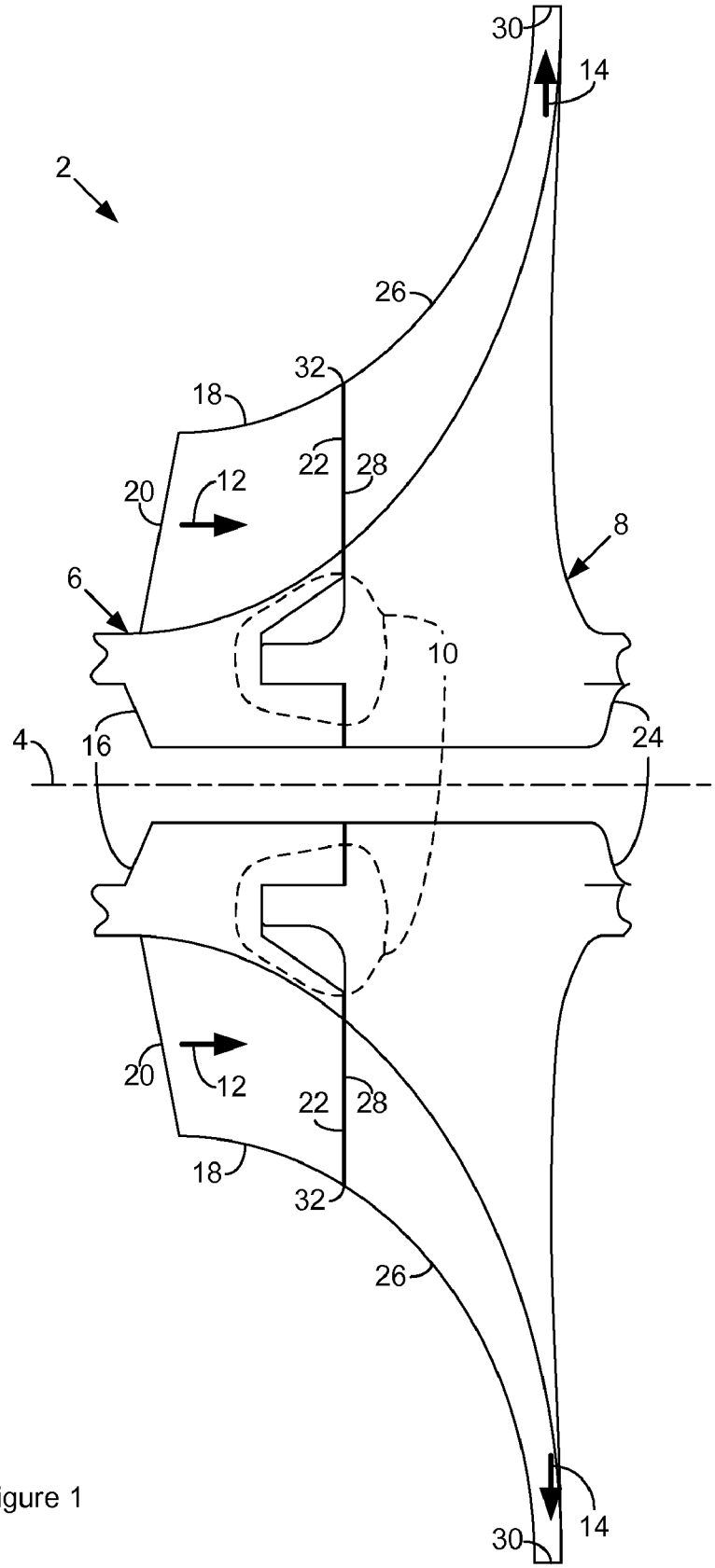
FIG. 1 is a cut-away side view of an impeller assembly according to a possible embodiment of the invention.

FIG. 1 is a cut-away side view of an impeller assembly 2 according to a possible embodiment of the invention. The impeller assembly 2 has an impeller axis 4, a nose section 6, a tail section 8 and a coupling 10. The impeller has a generally axial eye or inlet indicated by arrows 12 and a generally radial outlet indicated by arrows 14. Alternatively, the outlet 14 may discharge diagonally to the impeller axis 4, thereby providing a combination of radial and axial, or "mixed" flow.

The nose section 6 comprises a nose section central hub 16 and multiple nose vane sections 18, with each nose vane section 18 extending from a leading edge 20 to a nose section interface plane 22 that is may be generally normal or diagonal to the impeller axis 4. The nose section 6 preferably comprises a material that is durable enough to withstand foreign object impingement without damage, such as a ferrous material, and in particular a steel alloy.

The tail section 8 comprises a tail section central hub 24 and multiple tail vane sections 26, with each tail vane section 26 extending from a tail section interface plane 28 that is may be generally normal or diagonal to the impeller axis 4 to a vane tip 30. The tail section 8 preferably comprises a lightweight non-ferrous material that has a good strength-to-weight property, such as an aluminium or titanium alloy.

Figure 2:
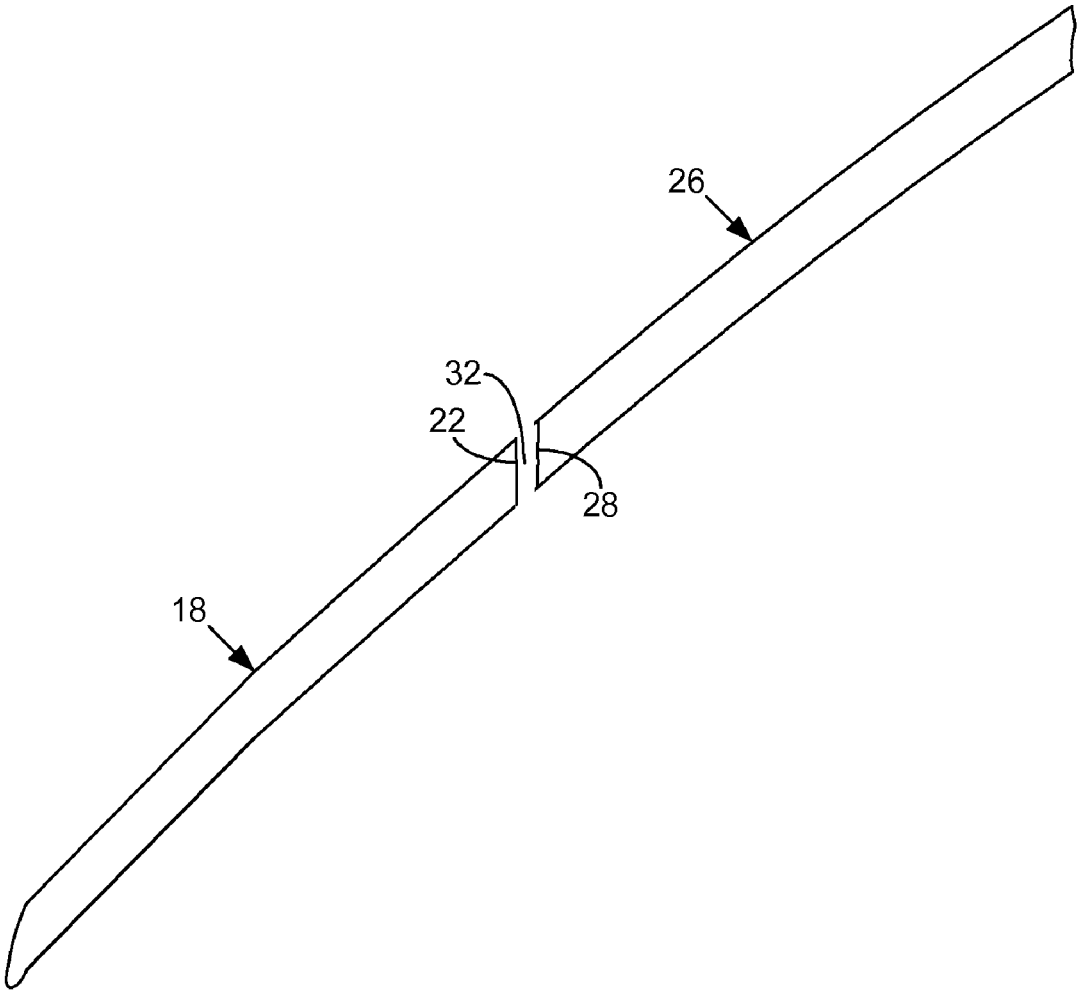
FIG. 2 is a cut-away top view of the impeller assembly of FIG. 1 that shows a portion of a nose vane section, a corresponding tail vane section and an axial gap between them.

The coupling 10 joins the nose section central hub 16 to the tail section central hub 24. It also aligns each one of the nose vane sections 18 with a corresponding one of the tail vane sections 26 to form a complete impeller vane. The coupling 10 also establishes an axial gap 32 between the radial nose section interface plane 22 and the radial tail section interface plane that is sufficient to allow for the difference in thermal expansion of the nose section 6 and the tail section 8. The axial gap 32 may be generally normal or diagonal to the impeller axis 4. FIG. 2 is a cut-away top view of the impeller assembly 2 that shows a portion of one of the nose vane sections 6, a corresponding one of the tail vane sections 8 and the axial gap 32 between them.

The coupling may be of any precision type that is suitable for coupling the nose section central hub 16 to the tail section central hub 24. For instance, a Curvic coupling, a dogs-and-slots coupling or a pilot coupling may be suitable. A coupling by way of interference fit or welding may also be suitable.

The described embodiments of the invention are only some illustrative implementations of the invention wherein changes and substitutions of the various parts and arrangement thereof are within the scope of the invention as set forth in the attached claims.

The invention claimed is:

1. An impeller with an axial inlet in relation to an impeller axis for pressurising a fluid that comprises:

a nose section that has a nose section central hub and multiple nose vane sections, each nose vane section extending from a leading edge to a generally radial nose section interface plane;

a tail section that has a tail section central hub and multiple tail vane sections, each tail vane section extending from a generally radial tail section interface plane to a vane tip;

a coupling that joins the nose section central hub to the tail section central hub and aligns each one of the multiple nose vane sections with a corresponding one of the multiple tail vane sections with an axial gap between the generally radial nose section interface plane and the generally radial tail section interface plane.

2. The impeller of claim 1, wherein the impeller has a generally radial outlet in relation to the impeller axis.

3. The impeller of claim 1, wherein the impeller has a mixed flow outlet in relation to the impeller axis.

4. The impeller of claim 1, wherein the nose section comprises a first material and the tail section comprises a second material different from the first material.

5. The impeller of claim 4, wherein the axial gap between the generally radial nose section interface plane and the generally radial tail section interface plane is sufficient to allow for the difference in thermal expansion of the nose section and the tail section.

6. The impeller of claim 4, wherein the nose section comprises a steel alloy.

7. The impeller of claim 4, wherein the tail section comprises an aluminium alloy.

8. The impeller of claim 4, wherein the tail section comprises a titanium alloy.

9. The impeller of claim 4, wherein the axial gap is generally normal to the impeller axis.

10. The impeller of claim 1, wherein the coupling is a Curvic coupling.

11. The impeller of claim 1, wherein the coupling is a dogs-and-slots coupling.

12. The impeller of claim 1, wherein the coupling is a pilot coupling.

13. The impeller of claim 1, wherein the coupling fastens the nose section to the tail section by interference fit.

14. The impeller of claim 1, wherein the coupling fastens the nose section to the tail section by welding.

15. An impeller with an axial inlet in relation to an impeller axis for pressurising a fluid that comprises:

a nose section comprising a first material that has a nose section central hub and multiple nose vane sections, each nose vane section extending from a leading edge to a generally radial nose section interface plane;

a tail section comprising a second material different from the first material that has a tail section central hub and multiple tail vane sections, each tail vane section extending from a generally radial tail section interface plane to a vane tip;

a coupling that joins the nose section central hub to the tail section central hub and aligns each one of the multiple nose vane sections with a corresponding one of the multiple tail vane sections with an axial gap between the generally radial nose section interface plane and the generally radial tail section interface plane.

16. The impeller of claim 15, wherein the impeller has a generally radial outlet in relation to the impeller axis.

17. The impeller of claim 15, wherein the impeller has a mixed flow outlet in relation to the impeller axis.

18. The impeller of claim 15, wherein the axial gap between the generally radial nose section interface plane and the generally radial tail section interface plane is sufficient to allow for the difference in thermal expansion of the nose section and the tail section.

19. The impeller of claim 15, wherein the nose section comprises a steel alloy.

20. The impeller of claim 15, wherein the tail section comprises an aluminium alloy.

21. The impeller of claim 15, wherein the tail section comprises a titanium alloy.

22. An impeller with an axial inlet and a radial outlet in relation to an impeller axis for pressurising a fluid that comprises:

a nose section comprising a steel alloy that has a nose section central hub and multiple nose vane sections, each nose vane section extending from a leading edge to a generally radial nose section interface plane;

a tail section comprising a non-ferrous material that has a tail section central hub and multiple tail vane sections, each tail vane section extending from a generally radial tail section interface plane to a vane tip;

a coupling that joins the nose section central hub to the tail section central hub and aligns each one of the multiple nose vane sections with a corresponding one of the multiple tail vane sections with an axial gap between the generally radial nose section interface plane and the generally radial tail section interface plane that is sufficient to allow for the difference in thermal expansion of the nose section and the tail section.

23. The impeller of claim 22, wherein the tail section comprises an aluminium alloy.

24. The impeller of claim 22, wherein the tail section comprises a titanium alloy.

* * * * *